United States Patent [19]

Halleck

[11] Patent Number: 4,689,715

[45] Date of Patent: Aug. 25, 1987

[54] STATIC CHARGE CONTROL DEVICE HAVING LAMINAR FLOW

[75] Inventor: Michael E. Halleck, Longmont, Colo.

[73] Assignee: Westward Electronics, Inc., Aurora, Colo.

[21] Appl. No.: 884,009

[22] Filed: Jul. 10, 1986

[51] Int. Cl.[4] ..... H05F 3/06

[52] U.S. Cl. ..... 361/213; 361/231; 361/235; 55/103; 55/138; 55/152

[58] Field of Search ..... 361/212, 213, 229-232, 361/235; 55/101, 103, 123, 129, 138, 141, 152

[56] References Cited

U.S. PATENT DOCUMENTS

| | | | |
|---|---|---|---|
| 2,264,495 | 12/1941 | Wilner | 361/235 X |
| 3,711,743 | 1/1973 | Bolasny | 361/231 |
| 4,151,577 | 4/1979 | Yavnieli et al. | 361/231 |
| 4,319,302 | 3/1982 | Moulden | 361/231 X |
| 4,630,167 | 12/1986 | Huggins | 361/231 X |

*Primary Examiner*—L. T. Hix
*Assistant Examiner*—D. Rutledge
*Attorney, Agent, or Firm*—Robert E. Harris

[57] ABSTRACT

A static charge control device is disclosed having laminar flow. The device utilizes a pair of spaced electrodes mounted adjacent to a pair of spaced apertures with the electrodes being positioned so as not to extend into the apertures. As specifically shown, a pair of needle electrodes are mounted on a mounting plate with each electrode being mounted above a different aperture in the plate with the needle electrodes extending outwardly from the mounting plate in a direction substantially normal thereto so that the tips of the electrodes extend in the direction of a laminar flow of air passing through the apertures in the plate, which air is provided by a fan positioned rearwardly of the mounting plate. Continuous positive DC voltage is applied to one needle electrode and continuous negative DC voltage is applied to the other needle electrode, and ions produced at the electrodes are layered onto the laminar flow of air passing through the apertures to thereby carry the ions toward a neutralizing area for neutralization of static charges thereat.

17 Claims, 3 Drawing Figures

STATIC CHARGE CONTROL DEVICE HAVING LAMINAR FLOW

FIELD OF THE INVENTION

This invention relates to a static charge control device, and, more particularly, relates to a static charge control device having laminar air flow.

BACKGROUND OF THE INVENTION

Electronic technology, with its associated solid state components, has evolved into the miniaturization of sensitive large scale integrated circuits used to develop sophisticated and low power electronic products for both consumer and industry. At least some of these devices, including particularly CMOS and MOSFET devices, are sensitive to damage and degradation from localized static charges, that can occur, for example, during packaging, assembly, and field installation. By way of specific example, it has been found that walking across a carpeted area can generate enough static voltage to destroy some CMOS devices, and statically charged, non-conductive plastics can present a field hazard when the charge is as little as 500 volts.

Static charge elimination, or at least reduction, during manufacture of sensitive systems, has been the target of considerable research as well as product development. Also, in the past few years, many papers have been written on the subject of electrical overstress and electrostatic discharge, and various symposiums and technical papers have been directed thereto.

Numerous active and passive types of equipment, ranging from complete room ionization systems to bench top products, have heretofore been suggested and/or utilized in an attempt to control static discharge. The active products essentially use the same general principle for minimizing or eliminating static charges, but utilize different techniques.

The application of the general principle normally utilized to control static charges consists of a means of generating equal and sufficient amounts of positive and negative air ions, and then propelling them into a neutralizing, or work, area in order to discharge any charged materials thereat.

Radioactive materials have heretofore been used for ion production with such radioactive materials producing alpha particles with sufficient energy to collide with neutral air molecules and dislodge electrons from their outer orbits. This can produce a nitrogen or oxygen molecule with one less electron than normal thereby creating a positive ion. The dislodged electron with a charge of about $1.6\times10^{-19}$ coulombs attaches itself to another neutral molecule and becomes a negative air ion. The isotope used to generate these ions have a short half life and must be replaced every six months to one year.

The radioactive system to generate ions requires a fan or blower since the ions will travel only between two and four inches from the radioactive source. The fan blows a turbulent flow of air through the positive and negative ions and propels them into the work area. The effective working distance of this system is related to how far the ions can be propelled before recombination occurs. Therefore, the larger the fan, the more cubic feet of air, and the faster and therefore farther the ions are propelled.

A second arrangement heretofore utilized to produce ions utilizes electrical means whereby a high voltage AC power supply is attached to a sharp needle point which intensifies the field surrounding the needle. The same mechanisms that produce the ions using a DC power supply, as brought out hereafter, apply to the AC power supply system. However, since the AC system voltage changes polarity at about 60 HZ intervals, both positive and negative ions can be produced from a single needle source.

The AC system to generate ions also requires a fan or a blower to propel the produced ions toward the work area since the 60 HZ line frequency used to generate the ions propels the electrons from the sharp needle point on the negative half of the cycle, and removes electrons from the surrounding air on the positive half of the cycle. This will result in ion generation that will be transported only about two to four inches from the needle source depending on the amplitude of the voltage. The fan blows a turbulent flow of air across a series of sharp needles and propels the ions into the work area. The effective working distance of this system is the same as described for the radioactive system. However, a long series of needles spaced at an appropriate distance can be suspended from the ceiling of a room, and gravity used to fill an entire room with oppositely charged ions.

A third arrangement (which is the type arrangement used in this invention) heretofore utilized to produce ions utilizes electrical means whereby a DC high voltage power supply is attached to a share needle point which intensifies the field surround the needle. The dielectric strength of air is overcome, corona discharge occurs, and current flows either into the needle point from the air for positive ions, or from the needle point into the air for negative ion generation. The field strength needed depends upon temperature and pressure and is generally between 20,000 and 30,000 volts per centimeter. Since it is generally easier to produce negative ions than positive ions, the positive power supply is usually adjusted to a higher DC potential than the negative supply to create the same number of ions.

The DC voltage system to generate ions requires at least two sharp needle points spaced at an appropriate distance with opposite polarity power supplies (generally under 10,000 volts each) in order not to exceed OSHA ozone limits of 0.1 ppm. The DC voltages utilized have also been pulsed either into the two needle points, or a single point may be used if the positive and negative voltages are alternately switched into the single point.

The DC voltage system of ion generation has used several methods to propel the ions into the work area. Since two independent needles are used, one to produce positive ions and the other to produce negative ions, electric fields of opposite polarities are generated at the needle points.

At the negative needle point, a constant source of electrons from the needle point are propelled into the air in front of the needle. Since like charges repel each other, the electrons are propelled by repulsion into the air, as are the negative air ions generated by corona discharge in the vicinity of the needle point.

At the positive needle point, electrons are pulled out of the surrounding air and positive ions are generated by corona discharge in the vicinity of the needle point. Again, the like charges repel each other and the positive ions are propelled by repulsion into the air.

If the discharge or needle points are closer spaced than about three to four feet, ion current will also flow between these electrodes. The magnitude will be related to the square of the distance between the electrodes. Also in the area, the positive ions will be attracted to the negative ions and recombination will occur.

The foregoing results in a constant source of positive and negative ions propelled thru the air by ion repulsion without the aid of a fan or blower. If the DC voltages at the needle electrodes are pulsed, the ions can be propelled even further distances than with bipolar constant DC. The increased propulsion distance will be related to the pulse time and is typically about two to four seconds. However, as the pulse frequency decreases, spurts of alternate polarity ions can charge up isolated conductors or non-conductors to several thousand volts for this two to four second period of time in close proximity to the pulsed DC equipment. This can be dangerous to sensitive electronic equipment.

A fan or blower has also been used to propel the ions generated by DC techniques even further into the work field. Again, the fan has been heretofore used to blow a turbulent flow of air across closely spaced electrodes of opposite polarity, either constant DC or pulsed DC. With pulsed DC systems the pulse time is usually decreased from a time of two to four seconds to ¼ to ½ second in order to reduce the spurts of alternate polarity ion charge concentrations that may be dangerous to sensitive electronic equipment. Thus, bipolar constant DC or pulsed DC systems can be used as total room air ionization systems without the use of a fan by suspending the needle emitters with appropriate spacings at the ceiling.

Static charge control devices having both positive and negative needle electrodes for producing ions are shown, for example, in U.S. Patents issued to Moulden (U.S. Pat. Nos. 4,319,302 and 4,333,123, for example), and in U.S. Patents issued to Saurenman (U.S. Pat. No. 3,624,448, for example), with the needle electrodes being pulsed by means of a voltage generator coupled to the needle electrodes. In the device shown in the referenced Moulden patents, the needle electrodes are positioned within plastic tubes, and in the device shown in the referenced Saurenman patent, the needle electrodes are positioned within shaped recesses.

Utilization of forced air units, such as a fan, to propel ions away from an area where ions have been produced, is also shown, for example, in U.S. Pat. Nos. 4,319,302, 4,333,123 and 3,624,448. Not all systems heretofore suggested, however, have required forced air units, and a system that does not utilize forced air is shown, for example, in U.S. Pat. No. 4,038,383 (Breton).

Balancing of ions directed to a work area has also been heretofore suggested, with balancing by adjusting the positioning of the needle electrodes being shown in U.S. Pat. No. 4,092,543 (Levy), for example, which patent also suggests that the prior art teaches such balancing by adjustment of the DC voltages supplied to the needle electrodes.

As can be appreciated from the foregoing, while various devices have heretofore been suggested for controlling static charges, improvements in such devices, including improvements in directing ions away from the ion producing area, in providing of voltages to the electrodes, and/or in positioning of the elements of the system, can still be utilized.

SUMMARY OF THE INVENTION

This invention provides an improved static charge control device having an improved arrangement for directing and/or carrying ions away from the ion producing area, having an improved voltage supply arrangement for producing ions at the electrodes, and/or an improved positioning arrangement of the electrodes relative to the other elements of the overall system to thereby effect more efficient static charge control.

More particularly, this invention provides an improved static charge control device having laminar flow in order to more efficiently direct ions to a neutralizing, or work, area. Positive and negative electrodes are positioned adjacent to, but do not extend into, apertures through which a laminar flow of air is directed, as, for example, by means of a fan, so that ions produced at the electrodes are layered onto the air passing through the apertures so that a laminar flow of air with ions layered thereon is thus conveyed to the neutralizing area.

It is therefore an object of this invention to provide an improved static charge control device.

It is another object of this invention to provide an improved static charge control device that includes positive and negative electrodes for separately providing positive and negative ions, which ions are more efficiently conveyed to a neutralizing area.

It is another object of this invention to provide an improved static charge control device having an improved voltage generating system for separately providing positive and negative voltages to the needle electrodes utilized for producing positive and negative ions.

It is still another object of this invention to provide an improved static charge control device having an improved arrangement of electrodes and apertures for carrying produced ions to a neutralizing area.

It is still another object of this invention to provide an improved static charge control device having laminar flow.

It is still another object of this invention to provide an improved static charge control device having electrodes mounted adjacent to, but not extending into, apertures through which a laminar flow of air is directed.

It is yet another object of this invention to provide an improved static charge control device having laminar flow with ions, produced at electrodes adjacent to the apertures through which a laminar flow of air is directed, being layered onto the laminar flow of air and thereby conveyed to a neutralizing area.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
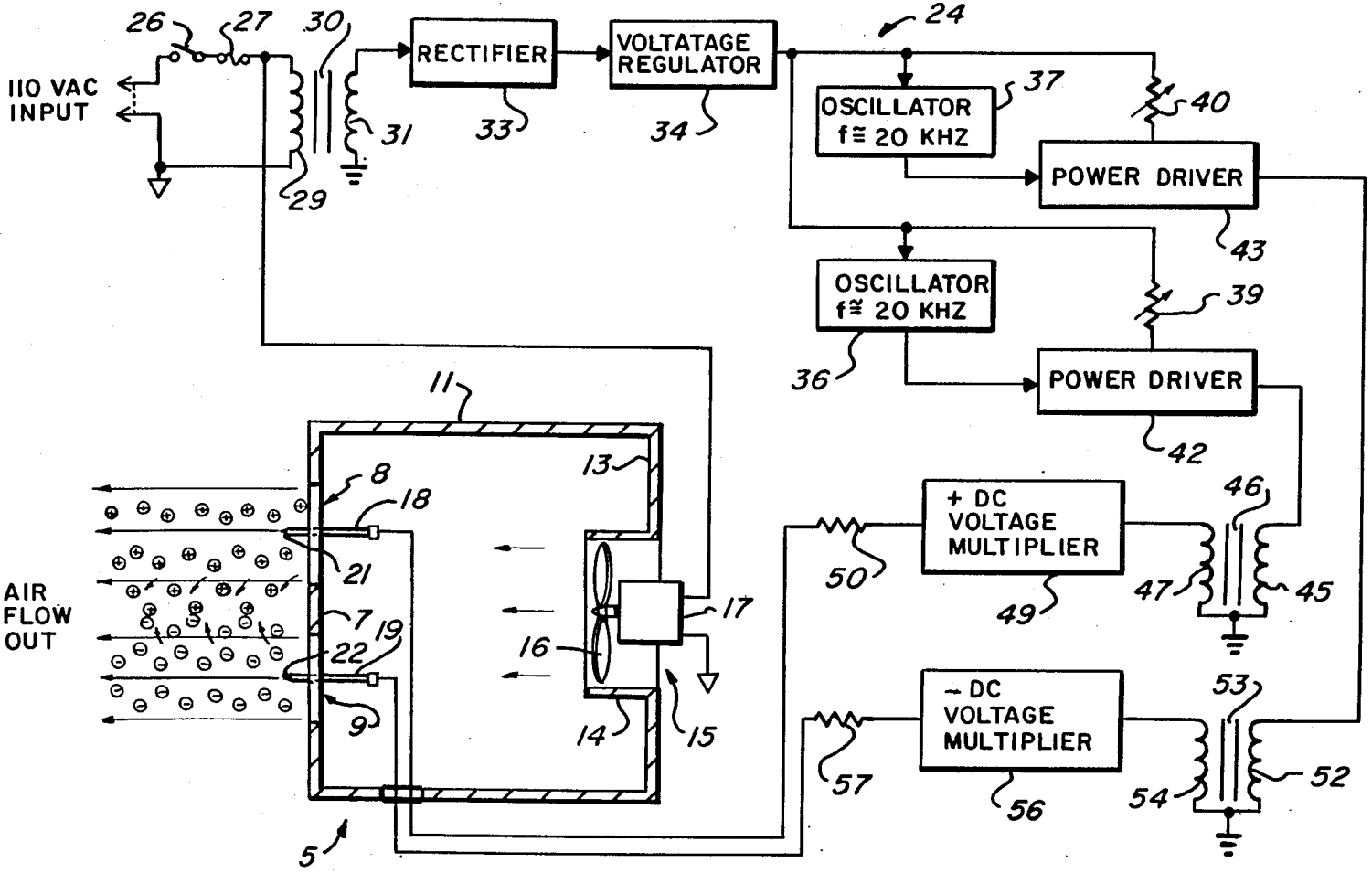
FIG. 1 is a schematic diagram of the electrostatic control device of this invention.

As brought out above, an electrostatic charge control device normally emits an equal number of positive and negative ions toward a neutralizing, or work, area to neutralize static charges thereat. Although an equal number of positive and negative ions in the air will result in an overall net charge of zero, such charges of opposite polarity can nevertheless coexist in an air environment since there are about $3\times10^{19}$ neutral air molecules for every ion in such an environment and the neutral air molecules also tend to isolate the charged air molecules.

Oppositely charged ions neutralize each other when they meet, however, and therefore a constant source of such ions must be made available for continuous static charge neutralization at a work area. This recombination process is also responsible for neutralizing static charges on isolated surfaces of non-conductive and conductive material.

An ion-ion recombination system actually represents a loss mechanism whereby the negative ions, and/or electrons, recombine with the positive ions. The loss rate factor is directly proportional to the concentration of positive ions (N+) and negative ions (N−) and, since a balanced condition should exist, then:

$$(d/dt)\,N+=(d/dt)\,N-$$

or $$\text{Loss}=(-KN+\times N-)$$

where K=recombination coefficient. If the number of positive ions (N+) is equal to the number of negative ions (N−), which occurs in almost all discharges, then Loss$=-KN^2$, where N is equal to the total number of positive and negative ions. If the Loss=(dn/dt), then $(dn/dt)=-KN^2$.

Integrating $(dn/dt)=-KN^2$ yields $(1/N)=(1/N_O)+Kt$ where K=recombination coefficient, t=time in seconds, and $N_0$ is the initial concentration at t=0. Therefore there exists a linear ion concentration with time.

The Thompson theory of recombination for low pressure systems suggests a 3-body mechanism. It assumes that two ions of opposite signs do not combine unless they are closer than a critical distance r. If the ions are within the critical distance, they will recombine only if there is a third gas molecule to carry off the energy released in the recombination process, that is, a 3-body collision process. The recombining ion has a potential energy equal to the average energy of thermal agitation.

In addition, a two body recombination system may also occur. In this case, the ions do not combine, but neutralize each other through the transfer of an electron from the negative to the positive ion. The energy liberated in this process results in electron excitation and imparts kinetic energy to the two resulting atoms, and may be independent of pressure.

A second system of radiative recombination may occur between an electron and positive ion, and its mechanism is different than that of the ion-ion recombination. A free electron is captured by an ion and accompanied by the emission of a photon.

Electron attachment represents a third system of recombination. This mechanism is common for gases whose outer electron shells are nearly filled whereby an electron attaches itself to a neutral atom or molecule. The electron affinity or energy of information of a negative ion doesn't occur with atoms having closed electron shells such as the noble gases, with the exception of hydrogen.

Neutral atoms and molecules represent a fourth system of recombination. An electron having a kinetic energy, $E_1$, may collide with a neutral gas molecule, XY, thereby supplying energy to produce a positive and negative ion with another resulting kinetic energy, $E_2$. Therefore, $E_2$=[$E_1$+electron affinity−ionization energy of atom X− dissociation energy of X and Y] into the neutral atoms X and Y. The energy of the electron must be greater than a certain threshold level for this reaction to occur (as an example, for oxygen the electron energy is approximately 21 volts).

The ionizing potential or the voltage E through which the electron must fall in order to have enough energy to dislodge an electron from a molecule is directly related to the energy required and inversely related to the charge of an electron ($1.6\times10^{-19}$ coulomb) which can be expressed as:

$$KE=Ve \text{ or } V=KE/e.$$

An average small gas molecule such as nitrogen or oxygen will have a diameter of about $2.5\times10^{-10}$ meters. Forces between molecules practically cease at a distance between molecules of about $10^{-9}$ meters or approximately the distance equivalent to 4 diameters.

If the air molecules were treated as an ideal gas at standard conditions, then the root-mean-square, or typical molecular speed of the molecule, follows the following relationship:

$$Vrms=\left(\frac{3P}{\rho}\right)^{\frac{1}{2}}\left(\frac{3\times1.013\ 10^5}{1.293}\right)=485\text{ m/sec}=942\text{ mph}$$

where

P=pressure of air (Newton/m$^2$)$=1.013\times10^5$ at 1 atmosphere, and $\rho$=density of air (Kg/m$^3$)=1.293 at 0° C. at 1 atmosphere.

Note that the kinetic energy per molecule of any gas is nearly the same.

$$KE=(MV^2/2)=\tfrac{1}{2}\times0.0288\times485^2=3387\text{ joules/mole,}$$

where

KE=energy in joules/mole,

M=molecular weight air=28.8 grams=0.0288 kg, and

V=velocity of molecule=485 m/sec.

The number of collisions that will occur between molecules follows the following relationship:

$$C=\pi d^2 n\sqrt{2}V=\pi\times(2.5\times10^{-8})^2\times3.\times10^{19}1.4\times48\text{-}500\approx4\times10^9$$

where d=Avg diameter of molecule=$2.5\times10^{-10}$ m=$2.5\times10^{-8}$ cm, n=no. of atoms per $cm^3$ in air=$3.0\times10^{19}$, and v=rms speed of molecule=485 m/sec=48500 cm/sec.

Therefore, $4\times10^9$=about 4 billion molecules will collide every second.

The mean free path between molecules at standard conditions before collision occurs will follow the following relationship:

$$\phi = \frac{1}{\pi\sqrt{2}\,Cd^2} = \frac{1}{\pi \times 1.4 \times 4.9 \times 109 \times (2.5 \times 10^{-8})^2} = 7.5 \times 10^{-6}\text{cm},$$

where v=rms speed of molecule=48500 cm/sec,

C=no. of collisions per second=$4\times10^9$/sec, and d=average diameter of molecule=$2.5\times10^{-8}$ cm.

Therefore, the average distance that the molecule can travel before it hits another molecule$\approx7.5\times10^{-6}/2.5\times10^{-8}$=300 diameters of an average molecule.

Figure 3:
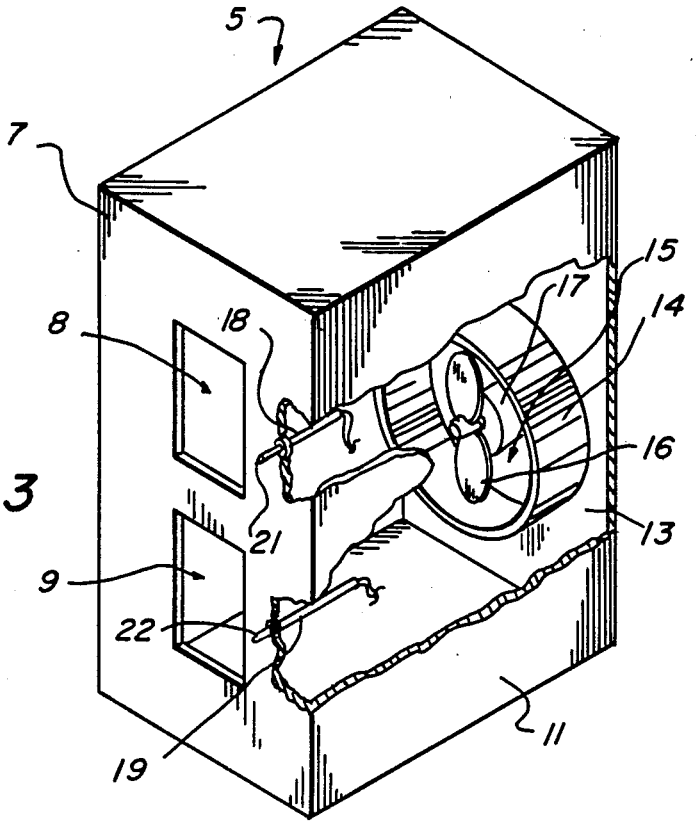
FIG. 3 is a partially broken-away perspective view of the device of this invention shown in FIGS. 1 and 2.

As best shown in FIGS. 1 and 3, housing 5 has a front wall 7 with spaced apertures 8 and 9 therein, side walls 11, and a rear wall 13 having inwardly directed flange 14 therein which defines an opening 15. As shown, a fan 16, driven by electric motor 11, is mounted on flange 14 in rear wall 13 to introduce air through aperture 15 into housing 5, with the air then passing through the housing and exiting therefrom through apertures 8 and 9 in front wall 7 of the housing.

Figure 2:
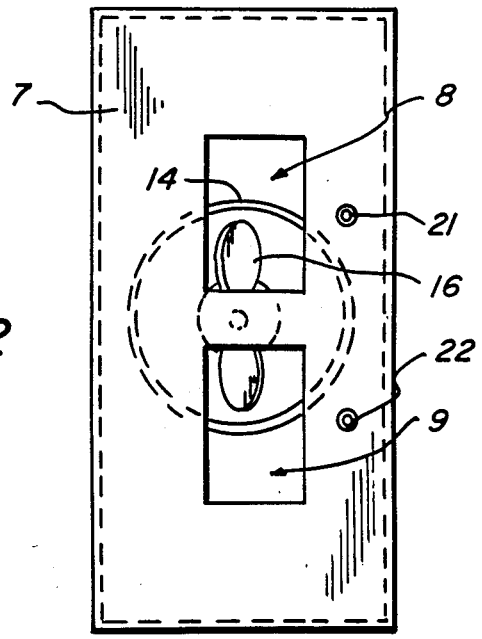
FIG. 2 is an end view of the mounting plate shown in FIG. 1 and illustrating relative positioning of electrodes with respect to apertures in the mounting plate.

The walls of housing 5 are formed of electrically non-conductive material, and, as indicated in FIGS. 2 and 3, apertures 8 and 9 in front wall 7 are preferably rectangular in shape (although square, circular, or parabolic shapes could be utilized, as desired, for a particular application).

Positive needle electrode 18 is mounted on front wall 7 adjacent to and above aperture 8 in the front wall, while negative needle electrode 19 is mounted on front wall 7 adjacent to and above aperture 9 in the front wall. As indicated in FIG. 1, needle electrodes 18 and 19 are positioned at front wall 7 so that the elongated rods forming the body of the electrodes extend forwardly from the wall, with tips 21 and 22 of needle electrode 18 and 19, respectively, being positioned forwardly of the front surface of wall 7. Thus, electrodes 18 and 19 do not extend into apertures 8 and 9 defined in front wall 7.

In a working embodiment of the invention, electrodes 18 and 19 were spaced ½ to ¾ inches above the top of apertures 8 and 9, respectively, and apertures 8 and 9 were 2¼ inches wide and 1⅛ inches high in a front wall measuring 6 inches wide and 3¼ inches high.

A voltage generating unit 24 is provided for supplying continuous DC voltages to the electrodes. As shown in FIG. 1, the unit operates from a standard 110 volt AC input power source with the AC power being coupled through switch 26 and fuse 27 to primary winding 29 of transformer 30 where the voltage is stepped down to about 12.6 volts AC at secondary winding 31. The output from transformer 29 is coupled from secondary winding 31 to rectifier 33 with the rectified output therefrom being coupled through voltage regulator 34 to supply a regulated +12 volts DC. While not specifically shown, this voltage could be supplied by a battery rather than being derived from the 110 volt AC source, if desired. The +12 volt DC is coupled to oscillators 36 and 37 (20 KHz) and is coupled through potentiometers 39 and 40 to power drivers 42 and 43.

Power driver 42 is connected to primary winding 45 of step-up transformer 46 (1:55), the secondary winding 47 of which provides about 1,000 volts p-p AC output to positive DC voltage multiplier 49. The output from positive DC voltage multiplier 49 is adjusted by potentiometer 39, for a positive voltage of between +4 KV and +8 KV. The output from positive DC voltage multiplier 49 is coupled to positive needle electrode 18 through resistor 50 which limits the current supply to needle electrode 18 to a safe value where the corona discharge generates positive ions.

In like manner, power driver 43 is connected to primary winding 52 of step-up transformer 53 (1:55), the secondary winding 54 of which provides about 1,000 volts p-p AC output to the negative voltage multiplier 56. The output from negative voltage multiplier 56 is coupled through resistor 57 to negative needle electrode 19 with the output from voltage multiplier 56 of between about −4 KV and −8 KV being adjusted by potentiometer 40 in order to provide a balanced ion output from the device (as brought out above, it is easier to generate negative air ions than positive air ions). Resistor 57 limits the current supply to needle electrode 19 to a safe value where the corona discharge generates positive ions.

The electronic circuitry described above is preferably mounted on a printed circuit board and housed within housing 5, and motor 17 (driving fan, or blower, 16) is powered directly from the line voltage, as indicated in FIG. 1.

Since needle electrodes 18 and 19 are located directly above their associated air outlet ports, or apertures, 8 and 9, respectively, in front wall 7 of housing 5, the ions produced by the electrodes are adjacent to the air streams that exit from housing 5 through output ports 8 and 9.

The improved device of this invention supplies an effective means of neutralizing static build-up on non-conductive or conductive isolated materials in the work area of interest. Heretofore, turbulent air has normally been passed across closely spaced needle electrodes that transport the ionized air molecules into the work area. The pressure of such an air flow reduced the mean path distance between collisions of molecules and accelerated recombination of the positive and negative ions.

Since the air does not flow by needle electrodes placed in the path of the air in the device of this invention, the transport system is quite different from that of prior devices.

As shown in FIGS. 2 and 3, needle electrodes 18 and 19 are located above air ports 8 and 9 and generate ions in the conventional manner. The ions are, however, then layed on top of the air flow from outlet ports 8 and 9 in a laminar fashion, to thereby charge up the top layers of the air stream from ports 8 and 9, and these ions then repel each other as they are carried downstream into the work, or neutralizing, area, as indicated in FIG. 1. As also indicated, the area between outlet ports 8 and 9 becomes filled with positive and negative ions due to attraction of unlike charges.

This system, due to incorporation of laminar flow (as opposed to a turbulent air flow), has been found to allow the opposite polarity ions to travel a greater distance before recombination occurs than has occurred using systems having turbulent air flow past the needle electrodes.

In addition, the air flow between the needle electrodes creates a lower pressure (slight vacuum) at the needle electrodes sites. This results in the mean path distance of the ions being increased and thereby increases the concentration of ions at the electrode sites due to corona discharge.

As a result, the device of this invention can either be reduced in size and yet provide the same neutralizing ability as previous equipment or enables a device having the same size as known devices to provide greater neutralization over distances than heretofore achieved. The use of a smaller fan and decreased air flow also has the advantage of reduction of dust and paper material being blown around in the work area.

As can be appreciated from the foregoing, this invention provides an improved static charge control device which utilizes laminar flow.

What is claimed is:

1. A static charge control device, comprising:

wall means having first and second spaced apertures therein;

first and second electrode means positioned on said wall means with each of said electrode means being adjacent to a different one of said first and second apertures in said wall means and being mounted so as not to extend into said apertures; and voltage means for providing a positive voltage to said first electrode means and a negative voltage to said second electrode means so that positive ions are produced at said first electrode means and negative ions are produced at said second electrode means, said produced ions being separately carried outwardly and away from said electrode means by air passing through said apertures in said wall means.

2. The device of claim 1 wherein said electrodes are elongated, and wherein said wall means is a plate having said electrodes mounted thereon so that said electrodes extend outwardly from said plate in the direction of ion movement away from said wall means.

3. The device of claim 1 wherein said device includes forced air means for directing air through said apertures in said wall means to carry ions outwardly and away from said wall means.

4. The device of claim 1 wherein said first and second electrodes are needle electrodes mounted on said wall means with the tip of each said needle electrode extending outwardly from said wall means.

5. The device of claim 1 wherein said voltage means includes means for providing a continuous DC voltage of positive polarity to said first electrode means and a continuous DC voltage of negative polarity to said second electrode means.

6. A static charge control device, comprising:

wall means having first and second spaced apertures therein;

first and second elongated electrodes mounted on said wall means with each of said electrodes being adjacent to a different one of said first and second apertures in said wall means and being mounted so as not to extend into said apertures;

voltage means for providing a continuous positive DC voltage to said first electrode and a continuous negative DC voltage to said second electrode so that positive ions are produced at said first electrode and negative ions are produced at said second electrode; and air moving means for directing a laminar flow of air through said apertures in said wall means so that ions adjacent to each said aperture are carried by said laminar flow of air outwardly from said electrodes toward a neutralizing area for neutralizing of ions thereat.

7. The device of claim 6 wherein said wall means are part of a housing having said air moving means mounted therein.

8. The device of claim 7 wherein said housing includes rear wall means having an aperture therein, and wherein said air moving means is a fan mounted at said aperture in sail rear wall means.

9. The device of claim 6 wherein said first and second electrodes are needle electrodes the tips of which extend outwardly from said wall means in the direction of air flow through said apertures.

10. The device of claim 9 wherein said air moving means creates a reduction of pressure at said first and second apertures to create enhanced concentration of ions at said first and second needle electrodes.

11. The device of claim 6 wherein each of said first and second electrodes are mounted adjacent to and above a different one of said first and second apertures of said wall means.

12. The device of claim 6 wherein said voltage means includes positive and negative voltage multiplier means with said positive voltage multiplier means providing said continuous positive DC voltage to said positive electrode, and said negative voltage multiplier means providing said continuous negative DC voltage to said negative electrode.

13. A static charge control device, comprising:

a housing having a front wall with first and second spaced apertures therein and a rear wall with a third aperture therein;

first and second needle electrodes mounted on said first wall and extending substantially normally forwardly from said first front wall with said first needle electrode being mounted adjacent to but not extending into said first aperture and said second needle electrode being mounted adjacent to but not extending into said second aperture;

voltage means for providing a continuous positive DC voltage to said first needle electrode and a continuous negative DC voltage to said second needle electrode so that positive ions are produced at said first needle electrode outwardly of said housing and negative ions are produced at said second needle electrode outwardly of said housing; and fan means at said third aperture in said rear wall of said housing to propel air forwardly to provide a laminar flow of air through said first and second apertures with said air flow acquiring and carrying layers of said ions away from said front wall of said housing toward a neutralizing area for neutralizing of ions thereat.

14. The device of claim 13 wherein said first electrode is mounted above said first aperture and said second electrode is mounted above said second aperture.

15. The device of claim 13 wherein said first and second apertures are rectangular in shape.

16. The device of claim 13 wherein said voltage means includes rectifier means, first and second oscillator means connected with said rectifier means, first and second transformer means connected with different ones of said first and second oscillator means; and first and second voltage multiplier means connected with different ones of said first and second transformer means, said first voltage multiplier means providing said continuous positive DC voltage to said first needle electrode and said second voltage multiplier means providing said continuous negative DC voltage to said second needle electrode.

17. The device of claim 16 wherein said first voltage multiplier means provides a positive voltage of between about 4,000 volts and 8,000 volts to said first needle electrode and said second voltage multiplier means provides a negative voltage of between about 4,000 volts and 8,000 volts to said second needle electrode, and wherein said voltage means includes voltage adjusting means for adjusting one of said voltages supplied to one of said needle electrodes to create a balanced ion output from said device.

* * * * *